US009021642B1

(12) United States Patent
Fox

(10) Patent No.: US 9,021,642 B1
(45) Date of Patent: May 5, 2015

(54) COMBINATION AXE, SLEDGE HAMMER AND PICK

(71) Applicant: Darin Andrew Fox, Phoenix, AZ (US)

(72) Inventor: Darin Andrew Fox, Phoenix, AZ (US)

( * ) Notice: Subject to any disclaimer, the term of this patent is extended or adjusted under 35 U.S.C. 154(b) by 184 days.

(21) Appl. No.: 13/648,044

(22) Filed: Oct. 9, 2012

(51) Int. Cl.
*B25F 1/00* (2006.01)
*B25D 1/00* (2006.01)
*B25D 7/00* (2006.01)

(52) U.S. Cl.
CPC ..... *B25F 1/006* (2013.01)

(58) Field of Classification Search
CPC ..... B25F 1/00; B25F 1/02; B25D 1/02; B26B 23/00; E04G 23/08
USPC ..... 7/144–147, 158, 159, 169; 30/308.1; D8/76, 81
See application file for complete search history.

(56) References Cited

U.S. PATENT DOCUMENTS 2,017,447 A 10/1935 Simmons
2,794,251 A 6/1957 Towne
3,219,316 A * 11/1965 Fried ..... 254/131
3,599,255 A * 8/1971 Carroll, Sr. ..... 7/138
3,604,028 A * 9/1971 Wardwell ..... 7/145
4,412,572 A 11/1983 Clark
4,932,127 A 6/1990 Burke
5,009,010 A 4/1991 Burlison
5,865,425 A * 2/1999 Meadows ..... 254/131
6,397,420 B1 * 6/2002 Roxton ..... 7/145
7,051,390 B2 * 5/2006 van Beek ..... 7/145
7,565,711 B1 * 7/2009 Schamadan ..... 7/145
7,634,830 B2 * 12/2009 Ryan ..... 7/166
D607,295 S 1/2010 Knight
D608,615 S 1/2010 Knight
7,694,392 B2 * 4/2010 Touchette ..... 16/430
7,735,172 B2 * 6/2010 Newton et al. ..... 7/166
8,677,537 B1 * 3/2014 Ingesson et al. ..... 7/146
2004/0261188 A1 * 12/2004 Mathis ..... 7/145
2009/0276962 A1 * 11/2009 Adams et al. ..... 7/144

* cited by examiner

*Primary Examiner* — David B Thomas
(74) *Attorney, Agent, or Firm* — Albert O. Cota

(57) ABSTRACT

A combination axe, sledge hammer and pick (CASHP) that is particularly designed for use by firefighters. The CASHP includes a front end and a rear end. The front end has an upper section that functions as an axe blade and the lower section functions as a sledge hammer. The rear section includes a pick that can be utilized for a variety of functions. By incorporating three tools in a single structure the weight that a firefighter carries is lessened. Thus, reducing fatigue and the time that is required to cut through an obstruction to reach fire victims.

20 Claims, 5 Drawing Sheets

COMBINATION AXE, SLEDGE HAMMER AND PICK

This application claims priority of Provisional Patent Application No. 61/592,697 filed Jan. 31, 2012.

TECHNICAL FIELD

The invention generally pertains to fire axes, and more particularly to a combination axe, sledge hammer and pick that is particularly designed for use by fire fighters.

BACKGROUND ART

Fire fighting is an extremely demanding occupation that requires agility, strength and stamina. Fire fighters in many cases are required to wear special protective clothing, breathing equipment and the use of tools that can add a large amount of weight.

The tools that are often carried to a fire scene are an axe, a sledge hammer and a pick. The weight of the individual tools can be excessive, especially when climbing a stairway or a ladder. The instant invention minimizes the weight problem by having in a single tool an axe, a sledge hammer and pick.

A search of the prior art did not disclose any literature or patents that read directly on the claims of the instant invention. However, the following U.S. patents are considered related:

| PATENT NO. | INVENTOR | ISSUED |
|---|---|---|
| 5,009,010 | Burlison | 23 Apr. 1991 |
| 4,932,127 | Burke | 12 Jun. 1990 |
| 4,412,572 | Clark | 1 Nov. 1983 |
| 2,794,251 | Towne | 4 Jun. 1957 |
| 2,017,447 | Simmons | 15 Oct. 1935 |

The U.S. Pat. No. 5,009,010 patent discloses an axe handle protector that is provided for a wood splitting axe. The axe includes a rigid arm supported and projecting rearward from the rear side of the axe head in a spaced relation beneath the handle of the axe. A resilient spacing and bracing body is disposed between the rear end of the arm and the opposing underside portion of the axe handle.

The U.S. Pat. No. 4,932,127 patent discloses a hand tool for chopping and splitting wood. The tool comprises a head having a blade end with a cutting edge, an eye hole extending in an axial direction through the head for receiving a handle, a pair of opposing side faces extending from the cutting edge, a recess extending into at least one of the pair of side faces, and a wedge removably received in the recess.

The U.S. Pat. No. 4,412,572 patent discloses a splitting axe having a head with an eye, and a handle having a portion received within the eye. The head has an anterior portion extending from one end of the eye and terminating in a cutting edge, and a posterior portion extending from the opposite end of the eye to the end of the cutting edge.

The U.S. Pat. No. 2,794,251 patent discloses an axe head for cutting metals. The axe head comprises an axe body having a handle opening therein and a cutting blade extending generally in the direction of the handle opening. The blade has leading and trailing edges with a cutting edge extending across a part of the blade portion extending from the leading edge diagonally toward the handle opening and the trailing edge.

The U.S. Pat. No. 2,017,447 patent discloses a straight steel blade in which a modified brush or brier hook blade is combined in one tool with an axe blade.

For background purposes and indicative of the art to which the invention relates, reference may be made to the following remaining patents found in the search.

| PATENT NO. | INVENTOR | ISSUED |
|---|---|---|
| D608,615 | Knight | 26 Jan. 2010 |
| D607,295 | Knight | 5 Jan. 2010 |

DISCLOSURE OF THE INVENTION

The invention discloses a combination axe, sledge hammer and pick (CASHP) that is particularly designed for use by fire fighters. In its basic design configuration the CASHP, also referred to as THE BREACH AXE™, is comprised of:

A. A head comprising:

a) a front end having an upper section that functions as an axe blade and a lower section that functions as a sledge hammer, and b) a rear end from where extends a pick, and c) a handle insertion bore that extends through the head.

B. A head handle having an upper section and a lower section, wherein the upper section is dimensioned to frictionally fit into the handle insertion bore.

The head is integrally formed of a high grade tool steel that is subsequently heat-treated to a Rockwell hardness of HRC 5-58. Also, the overall dimension of the head and head handle allows the CASHP to fit into a standard scabbard or a fire truck rack.

The CASHP is an innovative firefighting product that is designed to allow a firefighter to carry fewer tools when combating a fire. Carrying fewer tools results in less weight which reduces fatigue for the firefighter. The uniquely designed CASHP combines the working capability of an axe, a sledge hammer and a pick into one tool that allows a firefighter to more effectively combat a fire.

Currently, firefighters may have to carry an axe, a sledge hammer and a pick to effectively run a fire service call. Carrying multiple tools in the harsh environment typically found in a fire, can significantly degrade the energy of a firefighter which reduces his or her ability to fight the fire and prevent the effective attack on the fire. The increased firefighters fatigue also requires a longer recovery time as well, thus compromising future fire service calls.

The CASHP resolves many of the fatigue problems by combing in a single tool an axe, a sledge hammer and a pick. Only one tool needs to be carried into a fire scene, dramatically reducing the fatigue factor. In addition, the unique design of the CASHP allows the firefighter to use the tool more effectively, again reducing the effort required to fight a fire.

The head of the CASHP is made slightly broader, longer, and heavier than a conventional axe to allow easier penetration into wood, plaster, sheetrock, breaking windows, or cutting wires in a dwelling. The design also prevents the axe section from getting stuck in these surfaces, thereby allowing a firefighter to cut more rapidly without expending as much energy. Additionally, the unique design of the CASHP blade allows a firefighter to break through brick walls and stucco covered surfaces, break apart multiple layers of a roof, remove 2×4s, and bludgeon obstructions more quickly and with less effort. The blade and pick are slightly less than 12" in length, thereby allowing the tool to fit in standard scabbards and fire truck racks.

The CASHP is typically supplied with a hard hickory handle, which is shaped to provide an optimum grip during use. Alternatively, the wooden handle can be replaced with a high performance fiberglass handle, which is rated to 1,200 pounds of force, allowing a firefighter to lever more effectively without breaking the handle. The end of the handle has a non-slip grip, which is useful when using the CASHP with wet gloves.

In view of the above disclosure, the primary object of the invention is to provide within a single structure a tool that functions as either an axe, a sledge hammer or a pick.

In addition to the primary object of the invention it is also an object of the invention to produce an invention that:

- has a head that is designed to accommodate a particular use and environment,
- can be produced with a handle having a specific length,
- reduces the weight that is typically carried by firefighters by eliminating the necessity to carry a separate axe, sledge hammer and a pick,
- is easy to use.
- can be used by one hand or two hands,
- is extremely durable,
- can also be used by other first responders, and
- is cost effective from both a manufacturer's and consumer's point of view.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
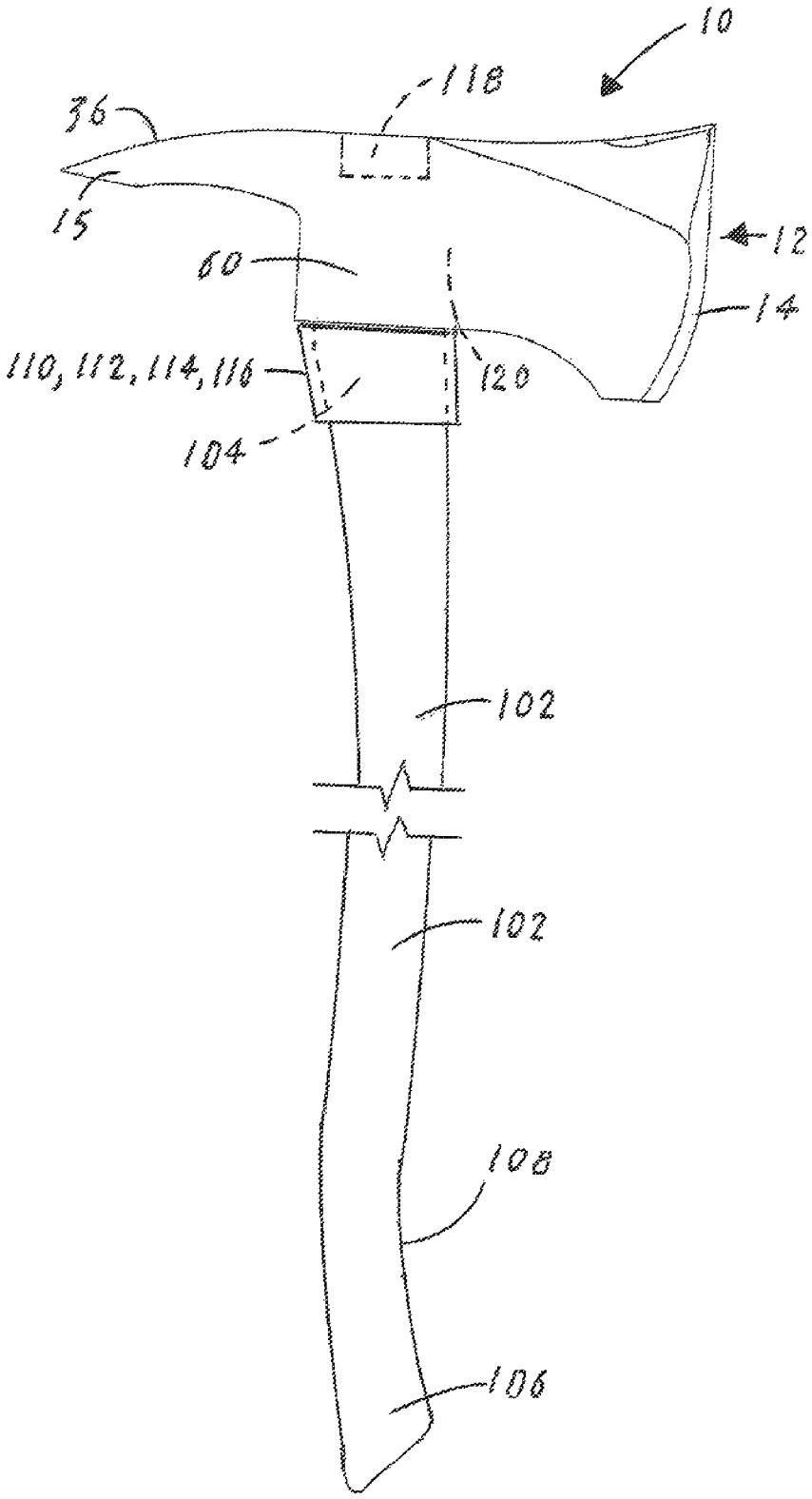
FIG. 1 is a right-side elevational view of the combination axe, sledge hammer and pick shown with a head attached to a typical axe handle.
Figure 2:
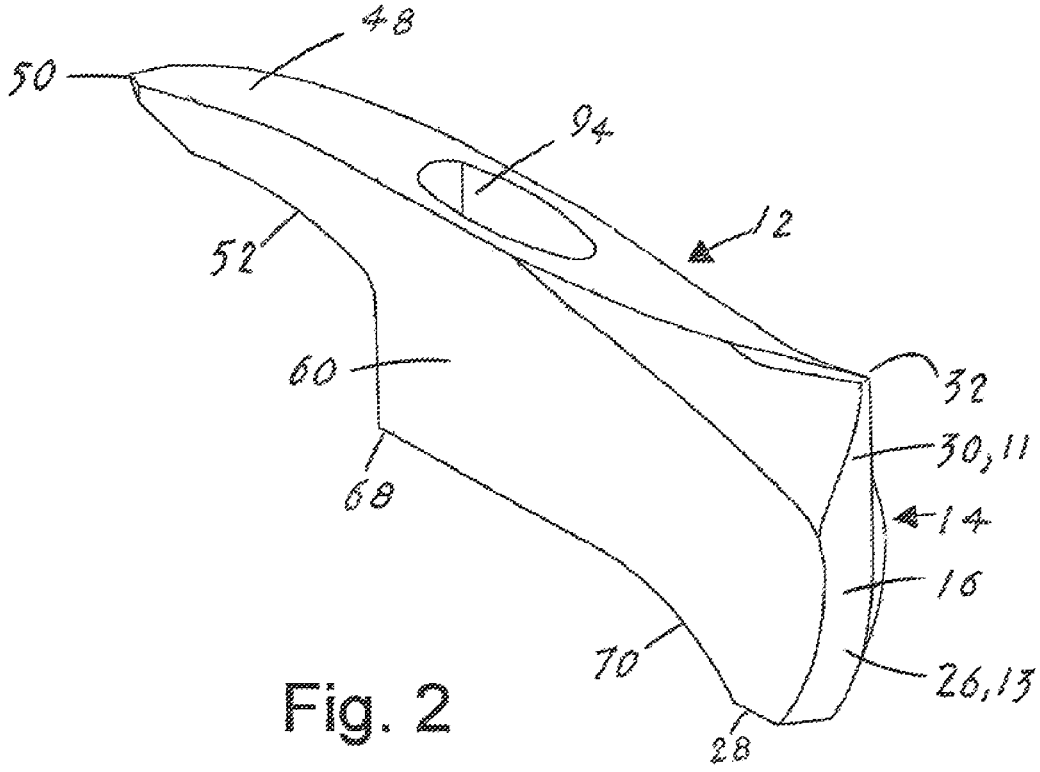
FIG. 2 is a rear-side orthographic view of the head.

The best mode for carrying out the invention is presented in terms that disclose a preferred embodiment of a combination axe, sledge hammer and pick 10 (CASHP 10). The preferred embodiment of the CASHP, as shown in FIGS. 1-8, is comprised of two major elements: a head 12 and a handle 102. The head 12 is comprised of a front end 14, a rear surface 36, a right side 60, a left side 74, an upper surface 88, and a lower surface 96. The handle 102 is comprised of an upper section 104 and a lower section 106.

The primary inventive element of the CASHP 10 is the head 12. However, for a full functional disclosure a typical handle 102 is described. The head 12 is shown attached to the head handle 102 in FIG. 1, and removed from the handle 102 in FIGS. 2-8.

Figure 3:
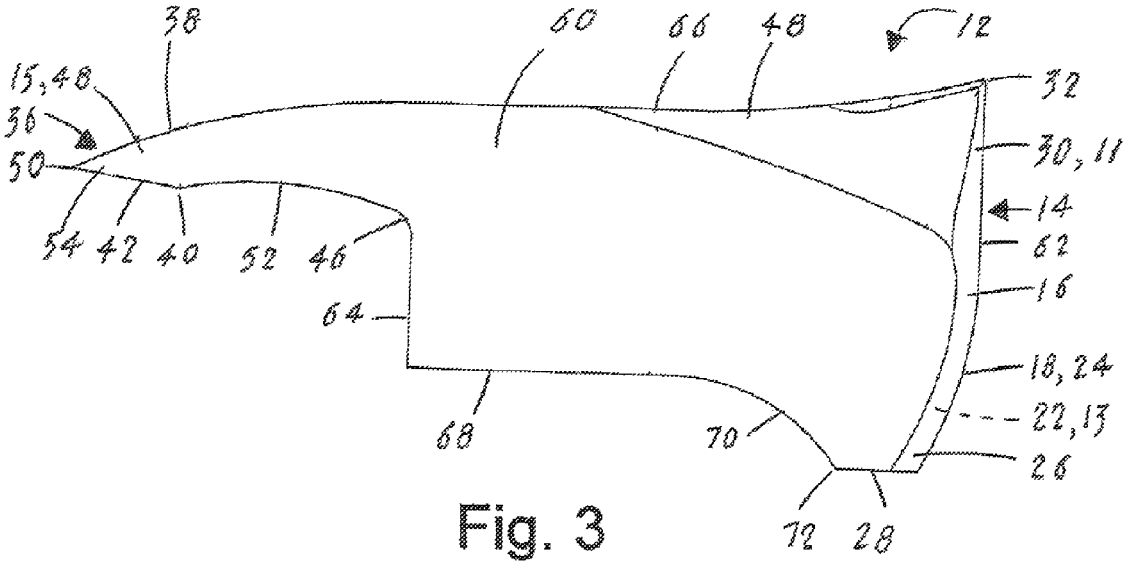
FIG. 3 is a right-side elevational view thereof.
Figure 4:
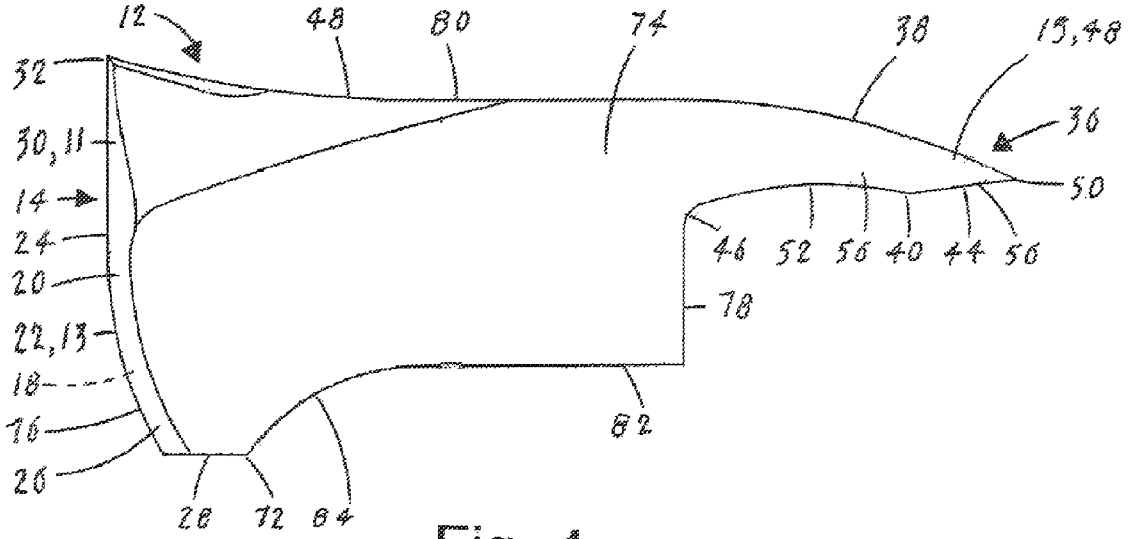
FIG. 4 is a left-side elevational view thereof.
Figure 5:
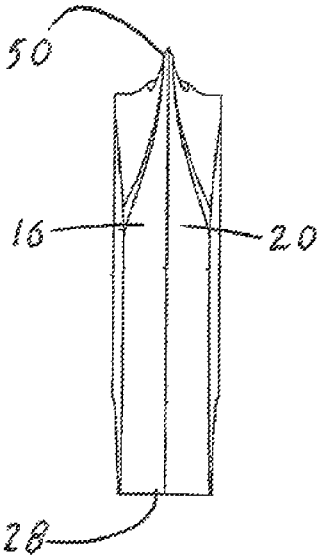
FIG. 5 is a front elevational view thereof.

The front end 14, as shown in FIGS. 3, 4 and 5, is divided into a right outward-tapered section 16 and a left outward-tapered section 20, as best shown in FIG. 5. The right outward-tapered section 16 has a first terminating edge 18 and the left outward-tapered section 20 has a second terminating edge 22 that coincides with the first terminating edge 18 to form a common edge 24. The common edge 24 is further divided into a lower section 26 that terminates at a lower flat section 28 and an upper section 30 that tapers inward and terminates at an upper axe blade point 32. The upper section 30 functions as an axe blade 11 and the lower section 26 functions as a sledge hammer 13.

Figure 6:
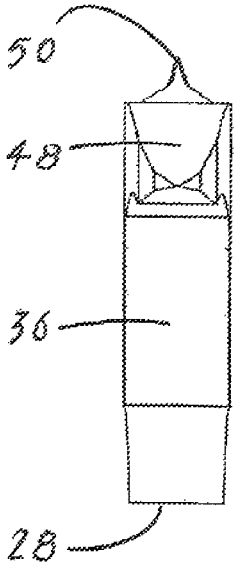
FIG. 6 is a rear elevational view thereof.

The rear surface 36, as shown in FIGS. 3, 4 and 6, has an upper edge 38, a lower edge 40, a right edge 42 and a left edge 44. Extending outward from the upper edge 38 and from a vertical midpoint 46 of the rear surface 36 is a pick 15. The pick 15 has a downward-sloping upper surface 48 that extends to a pick point 50 from where extends an inward curved section 52 that terminates at the vertical midpoint 46. The pick has a right side 54 and a left side 56 that taper inward and that also terminate at the pick point 50.

The right side 60, as shown in FIG. 3, has a front end 62, a rear end 64, an upper end 66 and a lower end 68. The front end 62 tapers inward and follows the vertical contour of the front end 14 that extends from the upper axe blade point 32 and terminates at the lower flat section 28. The lower end 68 of the right side 60 has a downward tapering edge 70 that abuts with an inner edge 72 of the lower flat section 28. The rear end 64 of the right side 60 terminates at the lower edge 40 of the rear surface 36.

The left side 74, which is a mirror image of the right side 60, is shown in FIG. 4, and has a front end 76, a rear end 78, an upper end 80 and a lower end 82. The front end 76 tapers inward and follows the vertical contour of the front end 14 that extends from the upper axe blade point 32 and terminates at the lower flat section 28. The lower end 82 of the left side 74 has a downward tapering edge 84 that abuts the inner edge 72 of the lower flat section 28. The rear end 78 of the left side 74 terminates at the lower edge 40 of the rear surface 36.

Figure 7:
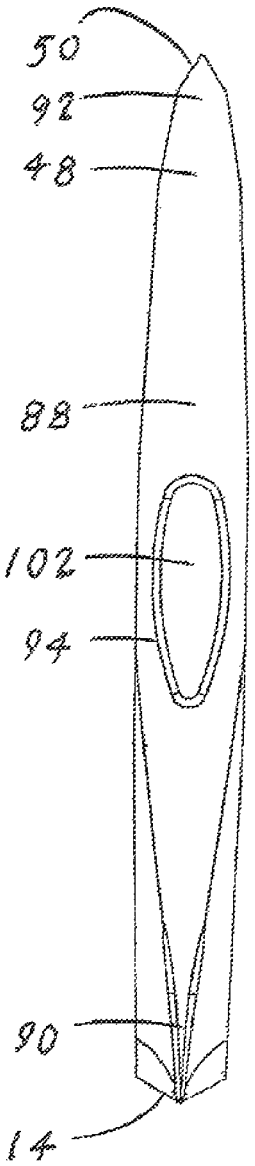
FIG. 7 is a top plan view thereof.

The upper surface 88, as shown in FIG. 7, has a front pointed end 90 and a rear end 92. The front pointed end 90 coincides with the upper axe blade point 32 on the front end 14 and the rear end 92 coincides with the lower edge 40 of the rear surface 36. The upper surface 88 has a substantially centered handle insertion bore 94.

Figure 8:
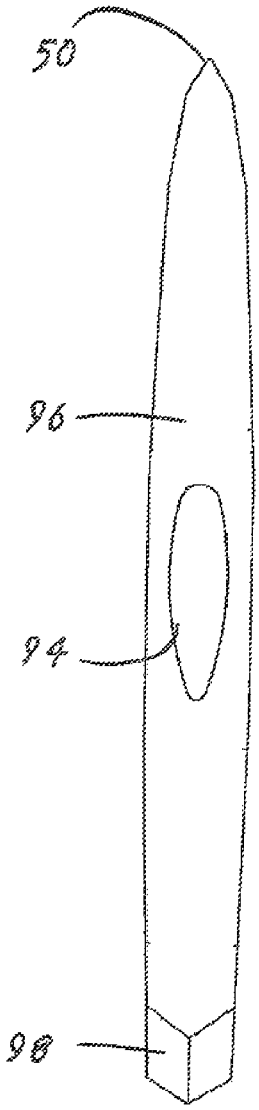
FIG. 8 is a bottom plan view thereof.

The final element that comprises the head 14 is the lower surface 96, as shown in FIG. 8. The lower surface 96 has a front end 98 that commences at the lower flat section 28 located on the front end 14. The front end 98 curves inward for a distance that substantially covers one-third of the lower surface 96. The lower surface 96 continues rearward and terminates at the lower edge 40 of the rear surface 38. The lower surface 96 also has a continuation of the handle insertion bore 94.

The head handle 102, as shown in FIG. 1, has an upper section 104 and a lower section 106. The upper section 104 is dimensioned to frictionally fit into the handle insertion bore 94, and the lower section 106 has an inward curved end 108 that allows a comfortable and firm hand grip. The handle is made of a material that is selected from the group consisting of wood, metal, fiberglass and carbon fiber.

As shown in FIG. 1, the upper section 104 of the hand 102 that is adjacent to the lower surface 98 of the head 14 is secured to the head 14 by a reinforcing means 110. The reinforcing means, as also shown in FIG. 1, can consist of a resilient sleeve 112, shrink wrap 114 and a resilient tape 116. To secure the handle 102 to the head a metal wedge 118 or an epoxy 120 can be utilized. For versatility, the handle 102 can be made with a length ranging from 12-36 inches.

While the invention has been described in detail and pictorially shown in the accompanying drawings it is not to be limited to such details, since many changes and modifications may be made to the invention without departing from the spirit and the scope thereof. Hence, it is described to cover any and all modifications and forms which may come within the language and scope of the claims.

The invention claimed is:

1. A combination axe, sledge hammer and pick (CASHP) comprising:

A. a head comprising:

a) a front end having an upper section that functions as an axe blade and a lower section that functions as sledge hammer, b) a rear end from where extends a pick, said head further having a handle insertion bore, and c) a handle insertion bore, B. a handle having an upper section and a lower section, wherein the upper section is dimensioned to frictionally fit into the handle insertion bore.

2. The combination axe, sledge hammer and pick as specified in claim 1 wherein said head is integrally formed of a high grade tool steel that is heat treated to a Rockwell hardness of HRC 5-58.

3. The combination axe, sledge hammer and pick as specified in claim 1 wherein the overall dimension of said head and said head handle allows the CASHP to fit into a standard scabbard or a fire truck rack.

4. The combination axe, sledge hammer and pick as specified in claim 1 wherein said handle is made of a material that is selected from the group consisting of wood, metal, fiberglass and carbon fibers.

5. The combination axe, sledge hammer and pick as specified in claim 4 wherein the portion of the upper section of said handle that is adjacent the lower surface of the head is reinforced by a reinforcing means.

6. The combination axe, sledge hammer and pick as specified in claim 5 wherein said reinforcing means is selected from the group consisting of a resilient sleeve, a heat shrink material and a resilient tape.

7. A combination axe, sledge hammer and pick CASHP comprising:

A. a head having:

a) a front end vertically divided into a right outward-tapered section having a first terminating edge, and a left outward-tapered section having a second terminating edge that coincides with the first terminating edge to form a common edge, wherein the common edge is further divided into a lower section that terminates at a lower flat section and an upper section that tapers inward and terminates at an upper axe blade point, wherein the upper section functions as an axe blade and the lower section functions as a sledge hammer, b) a rear surface having an upper edge, a lower edge, a right edge and a left edge, wherein extending outward from the upper edge and from a vertical midpoint of said rear surface is a pick having a downward-sloping upper surface that extends to a pick point from where extends an inward curved section that terminates at the vertical midpoint, wherein said pick has a right side and a left side that taper inward and terminate at the pick point, c) a right side having a front end, a rear end, an upper end and a lower end, wherein the front end tapers inward and follows the vertical contour of said front end that extends from the upper axe blade point of said front end and terminates at the lower flat section, wherein the lower end of said right side has a downward tapering edge that abuts with an inner edge of the lower flat section, and the rear end of said right side terminates at the lower edge of said rear surface, d) a left side having a front end, a rear end, an upper end and a lower end, wherein the front end tapers inward and follows the vertical contour of said front end that extends from the upper axe blade point of said front end and terminates a the lower flat section, wherein the lower end of said left side has a downward tapering edge that abuts with the inner edge of the lower flat section and the rear end of said left side terminates at the lower edge of said rear surface, e) an upper surface having a front pointed end that coincides with the upper axe blade point on said front end and a rear end that coincides with the lower edge on said rear surface, wherein said upper surface further having a substantially centered handle insertion bore, f) a lower surface having a front end that commences at the lower flat section on said front end, curves inward for a distance that substantially covers one-third of said lower surface, continues rearward and terminates at the lower edge of said rear surface, said lower surface having a continuation of the handle insertion bore, and B. a handle having:

a) an upper section dimensioned to frictionally fit into the handle insertion bore, and b) a lower section having an inward curved end that provides a comfortable and firm hand grip.

8. The combination axe, sledge hammer and pick as specified in claim 7 wherein said front end, said rear surface, said right side, said left side, said upper surface and said lower surface are integrally formed.

9. The combination axe, sledge hammer and pick as specified in claim 8 wherein said head is made of high grade tool steel.

10. The combination axe, sledge hammer and pick as specified in claim 9 wherein the head is heat treated to a Rockwell hardness of HRC 5-58.

11. The combination axe, sledge hammer and pick as specified in claim 7 wherein overall dimension of said head and said handle allow said CASHP to fit into a standard scabbard or a fire truck rack.

12. The combination axe, sledge hammer and pick as specified in claim 7 wherein said handle is made of a material that is selected from the group consisting of wood, metal, fiberglass and carbon fibers.

13. The combination axe, sledge hammer and pick as specified in claim 12 wherein the upper section of said handle that is adjacent to the lower flat surface of said head is secured by a reinforcing means.

14. The combination axe, sledge hammer and pick as specified in claim 13 wherein the reinforcing means is comprised of resilient sleeve or a shrink wrap.

15. The combination axe, sledge hammer and pick as specified in claim 13 wherein the reinforcing means is comprised of a resilient tape.

16. The combination axe, sledge hammer and pick as specified in claim 7 wherein said handle is secured to said head by inserting a metal wedge into said handle visible from the upper surface of said head.

17. The combination axe, sledge hammer and pick as specified in claim 7 wherein said handle is secured to said head by applying an epoxy to the interfacing surfaces of said head and said handle.

18. The combination axe, sledge hammer and pick as specified in claim 7 wherein said handle has a length ranging from 12-36 inches.

19. The combination axe, sledge hammer and pick as specified in claim 12 wherein said handle is made of a fiberglass material that is rated to 1200 pounds of force.

20. A combination axe, sledge hammer and pick CASHP comprising:

a head having:

a) a front end vertically divided into a right outward-tapered section having a first terminating edge, and a left outward-tapered section having a second terminating edge that coincides with the first terminating edge to form a common edge, wherein the common edge is further divided into a lower section that terminates at a lower flat section and an upper section that tapers inward and terminates at an upper axe blade point, wherein the upper section functions as an axe blade and the lower section functions as a sledge hammer, b) a rear surface having an upper edge, a lower edge, a right edge and a left edge, wherein extending outward from the upper edge and from a vertical midpoint of said rear surface is a pick having a downward-sloping upper surface that extends to a pick point from where extends an inward curved section that terminates at the vertical midpoint, wherein said pick has a right side and a left side that taper inward and terminate at the pick point, c) a right side having a front end, a rear end, an upper end and a lower end, wherein the front end tapers inward and follows the vertical contour of said front end that extends from the upper axe blade point of said front end and terminates at the lower flat section of said front end, wherein the lower end of said right side has a downward tapering edge that abuts an inner edge of the lower flat section, and the rear end of said right side terminates at the lower edge of said rear surface, d) a left side having a front end, a rear end, an upper end and a lower end, wherein the front end tapers inward and follows the vertical contour of said front end that extends from the upper axe blade point of said front end and terminates a the lower flat section of said front end, wherein the lower end of said left side has a downward tapering edge that abuts with the inner edge of the lower flat section and the rear end of said left side terminates at the lower edge of said rear surface, e) an upper surface having a front pointed end that coincides with the upper axe blade point on said front end and a rear end that coincides with the lower edge on said rear surface, wherein said upper surface has adjacent the rear end a handle insertion bore, and f) a lower surface having a front end that commences at the lower flat section on said front end, curves inward for a distance that substantially covers one-third of said lower surface, continues rearward and terminates at the lower edge of said rear surface, said lower surface having a continuation of the handle insertion bore.

* * * * *